US009080273B2

(12) United States Patent
Moschütz et al.

(10) Patent No.: US 9,080,273 B2
(45) Date of Patent: Jul. 14, 2015

(54) METHOD FOR THE TREATMENT OF WASHING AND PROGRAM-CONTROLLED WASHING MACHINE SUITABLE THEREFOR

(75) Inventors: Harald Moschütz, Groβbeeren (DE); Christoph Oertel, Berlin (DE)

(73) Assignee: BSH HAUSGERÄTE GMBH, Munich (DE)

( * ) Notice: Subject to any disclaimer, the term of this patent is extended or adjusted under 35 U.S.C. 154(b) by 1564 days.

(21) Appl. No.: 12/669,197

(22) PCT Filed: Jul. 3, 2008

(86) PCT No.: PCT/EP2008/058628

§ 371 (c)(1),
(2), (4) Date: Aug. 19, 2010

(87) PCT Pub. No.: WO2009/010404

PCT Pub. Date: Jan. 22, 2009

(65) Prior Publication Data

US 2010/0306925 A1 Dec. 9, 2010

(30) Foreign Application Priority Data

Jul. 18, 2007 (DE) ..... 10 2007 033 493

(51) Int. Cl.

| | |
|---|---|
| ***D06L 1/20*** | (2006.01) |
| ***D06F 33/00*** | (2006.01) |
| ***D06F 35/00*** | (2006.01) |

(52) U.S. Cl.

CPC ..... *D06F 35/006* (2013.01); *D06F 35/005* (2013.01)

(58) Field of Classification Search

CPC ..... D06F 35/006; D06F 35/005
USPC ..... 8/137; 68/12.02
See application file for complete search history.

(56) References Cited

U.S. PATENT DOCUMENTS

| | | | | |
|---|---|---|---|---|
| 4,987,627 | A * | 1/1991 | Cur et al. | 8/158 |
| 5,167,722 | A * | 12/1992 | Pastryk et al. | 134/33 |
| 5,345,637 | A * | 9/1994 | Pastryk et al. | 8/158 |
| 6,557,382 | B1 * | 5/2003 | Koike et al. | 68/17 R |
| 2006/0010613 | A1 * | 1/2006 | Jeon et al. | 8/158 |
| 2006/0096336 | A1 | 5/2006 | Sumida et al. | |
| 2006/0248658 | A1 * | 11/2006 | Ha et al. | 8/147 |
| 2007/0283506 | A1 * | 12/2007 | Wong et al. | 8/149.3 |
| 2008/0028801 | A1 | 2/2008 | Czyzewski et al. | |

FOREIGN PATENT DOCUMENTS

| | | |
|---|---|---|
| DE | 2221448 | 11/1972 |
| DE | 4104450 A1 | 8/1992 |
| EP | 0278239 A1 | 8/1988 |
| EP | 0781881 A1 | 7/1997 |

* cited by examiner

*Primary Examiner* — Michael Barr
*Assistant Examiner* — Benjamin L Osterhout
(74) *Attorney, Agent, or Firm* — Nixon & Vanderhye P.C.

(57) ABSTRACT

A method for treating a load of washing by sensing a quantity of liquid in an outer tub with a sensor, monitoring a signal from the sensor, wetting a washing with a quantity of water that is less than a quantity of water required to saturate the washing, rotating the drum at a first speed which is greater than a speed required to spread the washing around the drum, until a space between the outer tub and a drum is filled with suds and the suds reach the interior of the drum, and activating a heater.

18 Claims, 1 Drawing Sheet

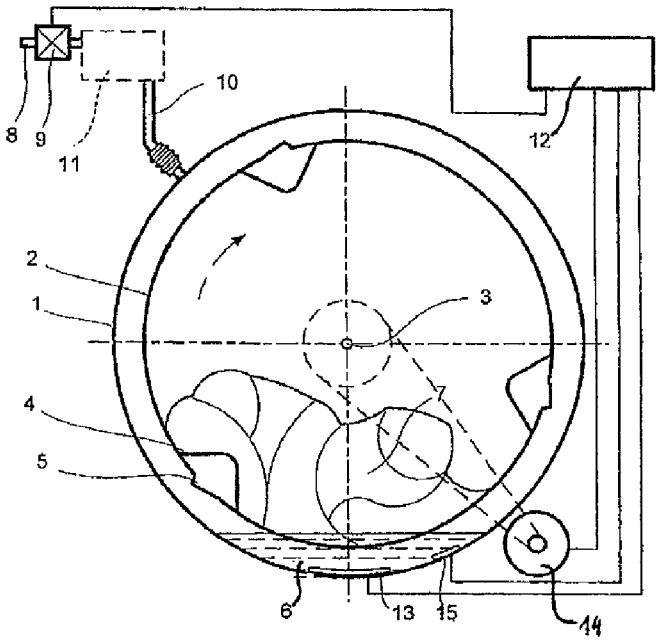
8
9
11
10
12
2
1
3
4
5
7
6
13
15
14

METHOD FOR THE TREATMENT OF WASHING AND PROGRAM-CONTROLLED WASHING MACHINE SUITABLE THEREFOR

This application is a U.S. National Phase of International Application No. PCT/EP2008/058628, filed Jul. 3, 2008, which designates the U.S. and claims priority to German Application No. 102007033493.3, filed Jul. 18, 2007, the entire contents of each are hereby incorporated by reference.

BACKGROUND OF THE INVENTION

The invention relates to a method for treating washing in a program-controlled washing machine and a washing machine that is particularly suitable for implementing said method.

With a known washing method the washing to be washed is only treated with a detergent solution, also referred to as liquor, comprising a quantity of water, which is sufficient for the washing to be washed to be saturated with water and to allow an exchange between the heating unit and the detergent solution by way of a remaining, smallest possible quantity of free liquor, generally 2 to 3 liters, to heat the detergent solution and the washing. This is ensured by a suitable method for regulating the water level in the drum and by tailoring the quantity of water to the absorption capacity of the washing. The free liquor is obtained by deducting the quantity of water bound in the washing from the quantity of water introduced into the washing machine. Cotton fabric binds around 200% of its own weight, so that a 6 kg load of cotton fabric binds approximately 12 l water.

In DE 10 2004 039 662 A1 a program-controlled washing machine is described with a wetting process, which can be tailored to the necessary quantity of water in a washing drum supported in a rotatable fashion about a non-vertical axis in an outer tub by means of a water supply system and a control facility, it being possible to control the timing of the supply of water to the outer tub and the wetting process being divided into the same number of phases (Ph1 to Ph3) as there are quantity classifications (small, medium, large) for the washing to be treated.

The energy consumption of a washing machine is essentially determined by the energy required to heat the water. Reducing the quantity of water in the washing machine would therefore be desirable, in particular reducing the quantity of free liquor. However the transfer of heat from the heating unit to the washing must be brought about by the free liquor. A further reduction of the liquor and therefore a reduction of the energy consumption are therefore very difficult to achieve.

BRIEF SUMMARY OF THE INVENTION

The object of the invention is therefore to provide a method for treating washing in a program-controlled washing machine, with which energy can be saved compared with known methods.

The object is also to demonstrate a washing machine that is suitable for implementing this method.

Preferred developments of the washing machine here correspond to preferred developments of the method and vice versa, even if this is not set out in a detailed fashion.

The invention therefore relates to a method for treating washing with an aqueous detergent solution in a program-controlled washing machine comprising a solution drain system that is situated on the base of an outer tub and a solution pump, a heating unit, a sensor for determining the quantity of liquid or suds in the outer tub, a sensor signal being monitored during the method and comprising a drum, the method comprising the following steps:

a) wetting a load (a1) of washing with a quantity (a2) of water that is less than the quantity (a3) of water required to saturate the washing (saturation quantity);

b) rotating the drum at a speed $U_1$, which is greater than a speed $U_A$ required to spread the washing around the drum, until a space between the outer tub and the drum is filled with suds and the suds reach the interior of the drum; and c) activating the heating unit and heating the suds and thus the washing.

The speed $U_A$ required to spread the washing around the drum is the drum speed at which the washing can be spread over the inner wall of the drum, for example a speed in the region of 300 to 500 rpm.

For a 6 kg load (a1) of washing made of cotton fabric for example a quantity (a2) of water of 10 liters could be introduced.

In the case of cotton fabric the saturation quantity (a3) of water is approximately double the load (a1). In the case of synthetic fabrics which are less able to absorb water, the saturation quantity (a3) can be much smaller. The values for the saturation quantity (a) are known per se, so the water quantity (a2) in a wash program can be predetermined.

The load (a1) or the type of washing to be treated or both can optionally be determined here by a measure known per se.

To determine the load (a1) it is possible for example in method step a) to compare a hydrostatic pressure p measured with the aid of the sensor with the quantity of water introduced. The washing in the drum absorbs water, which therefore cannot contribute to an increase in the hydrostatic pressure. By comparing the measured hydrostatic pressure and the quantity of water supplied—the absolute values and their change over time—with corresponding values for laundry soaking stored in the program controller of a washing machine, it is possible to determine the washing item (load (a1)) and its degree of soaking (degree of wetting). As a result it is possible to tailor the duration of wetting in step a) very precisely to the predetermined washing item. Generally water is introduced until a predetermined threshold value $p_1$ for the hydrostatic pressure p and a predetermined threshold value $(\Delta p/\Delta t)_1$ for the temporal gradient of the hydrostatic pressure p is reached. This generally signals adequate wetting of the washing item for the inventive method in a program, so step a) is terminated and step b) can be started.

According to the invention the water quantity (a2) in relation to the weight of the load (a1) is preferably 90 to 170%, particularly preferably 130 to 150%.

In step b) of the method some of the detergent solution is spun off and conveyed into a gap between the drum and the outer tub. If in this process the water quantity increases so that the rotating drum dips into the detergent solution, the significant mechanical action of the drum will cause the detergent solution to foam. This can increase the volume of the detergent solution significantly so that the entire space between the drum and the outer tub is filled. The suds are then pushed through a front gap between the drum and outer tub into the interior of the drum. There the suds are subjected to the centrifugal force of the drum, pressed through the washing and transported back into the space between the drum and the outer tub. The circulation of the suds through the washing is thus established.

The complete filling of the outer tub with suds can be determined by suitable sensors. A standard sensor for determining the water level can be used as the sensor for determining the quantity of liquid or suds in an outer tub, its sensor signal being monitored during the method. Such a sensor generally measures a hydrostatic pressure p and or the temporal gradient $(\Delta p/\Delta t)_1$ of the hydrostatic pressure p. Complete filling with suds is generally indicated by a sudden pressure increase at the sensor. This circumstance can be taken as a prompt to initiate step c).

In one preferred embodiment the inventive method also comprises, after step c), a step d) when a predetermined washing temperature $T_W$ is reached, reversing operation of the drum at a speed $U_2$, which is lower than the speed $U_A$ required to spread the washing around the drum.

The speed $U_2$ can vary widely. A speed $U_2$ in the region of 30 to 80, in particular 40 to 60, for example 50 rpm is preferably used. At such speed the tumbling and rubbing together of the washing items and the action of the detergent solution in particular causes the dirt present in the washing to be detached from the fibers.

The inventive method preferably comprises, in addition to step d) and after it, a step e) filling of the outer tub with water of a quantity sufficient so that in addition to the saturation quantity (a3) a quantity (a4) of free liquor is present, which is sufficient for a space between the outer tub and the drum at a lower end of the drum to be filled with water and to allow the washing to be wetted.

Generally for a 6 kg load (a1) a quantity of water of 3 to 8 liters, for example 5 liters, is introduced. The total quantity of water then present can correspond to the quantity of water for a conventional wash program.

In one particularly preferred embodiment the method also comprises, in addition to the steps a) to e) and after step e), a step f) reversing operation of the drum at a speed $U_2$, which is lower than the speed $U_A$ required to spread the washing around the drum.

The mechanical action due to the reversing operation of the drum causes the detergent solution to flow through the washing. The detached dirt can be washed out and transferred to the detergent solution.

In one particularly preferred embodiment of the inventive method in step c) when a predetermined temperature $T_Z$, which is lower than the wash temperature $T_W$, is reached (for example 30 or 40° C.), the heating process is interrupted and the drum is operated at a speed $U_2$, which is lower than the speed $U_A$ required to spread the washing around the drum, in a reversing fashion. This embodiment is particularly advantageous for dirt containing proteins, as it is thus possible to prevent the dirt being burned in. Such a phase is referred to as a bio-enzyme phase.

In a further preferred embodiment of the inventive method, in which step d) is implemented, in step d), at least once as an interruption of step d), a step g) rotating of the drum at a speed $U_1$, which is higher than the speed $U_A$ required to spread the washing around the drum, is implemented.

In this process the drum is preferably rotated for a time period from 60 seconds to 3.5 minutes, in particular 90 to 150 seconds, for example 120 seconds, at a speed $U_1$, which is higher than the speed $U_A$ required to spread the washing around the drum. The speed $U_1$ can for example be 250 to 600 rpm, in particular 300 to 500 rpm. Step g) in particular brings about a redistribution of the detergent solution. A further heating process using the heating unit could also take place in step g).

The washing process is generally terminated at the end of step f).

During the further course of the method the washing can be rinsed and spun as in a conventional wash program.

The subject matter of the invention is also a washing machine with a program controller for controlling the program sequence, a drum supported in a rotatable fashion in an outer tub, a solution drain system situated on the base of the outer tub with a solution pump, a drive motor for the drum, a heating unit, a sensor for determining a quantity of liquid or suds in an outer tub and switching means for rotating and stopping the drum, the switching means and the sensor being set up to implement the inventive method described above.

The invention has numerous advantages. When the inventive method is implemented, a significantly smaller quantity of water is heated than with conventional methods. This makes a significant energy saving possible.

BRIEF DESCRIPTION OF THE DRAWINGS

One exemplary embodiment of the invention is described below with reference to FIG. 1.

FIG. 1 is a schematic diagram of the parts of a washing machine of relevance for the description which follows, in which washing machine a method as described here can be implemented. Other embodiments are possible. The washing machine of the embodiment shown in FIG. 1 has an outer tub 1, in which a drum 2 is supported in a rotatable fashion and can be operated by a drive motor 14. In accordance with recent ergonomic knowledge relating to the operation of such washing machines, the axis of rotation 3 of the drum 2 is aligned upward and forward by a small angle (e.g. 13°) from the horizontal, providing easier access into and viewing of the interior of the drum 2. This arrangement, in conjunction with specially shaped agitators 4 and scooping facilities 5 for the detergent solution 6 on the inner surface of the drum casing, also brings about a more intensive flow of detergent solution and suds through the washing 7 and a reduction of the free liquor.

DETAILED DESCRIPTION OF EXEMPLARY EMBODIMENTS OF THE PRESENT INVENTION

The suds formed in step a) of the method in particular fill a space between the drum 2 and the outer tub 1.

In the preferred step e) water is introduced in a quantity which suffices to fill a space between the outer tub 1 and the drum 2 at a lower end of the drum with water to allow the washing to be wetted. For the embodiment in FIG. 1 this means that the water in the outer tub 1 reaches at least the lowest point of the drum 2 and the washing contained therein.

The washing machine also has a detergent solution supply system, comprising a water connection fitting for the domestic water supply network 8, an electrically controllable valve 9 and a supply line 10 to the outer tub 1, which can optionally also pass by way of a detergent dispenser (detergent dispenser tray) 11, from which the supplied water can transport portions of detergent into the outer tub. Also present in the outer tub 1 is a heating unit 13. The valve 9 and the heating unit 13 can be controlled by a control facility (program controller) 12 as a function of a program sequence, which can be associated with a time program and/or the reaching of certain measurement values of parameters such as detergent solution level, detergent solution temperature, rotation speed of drum 2, etc. within the washing machine. 15 indicates a sensor for measuring the hydrostatic pressure p in the outer tub 1.

The invention claimed is:

1. A method for treating a load of washing with an aqueous detergent solution in a program-controlled washing machine which includes a solution drain system that is situated on the base of an outer tub and a solution pump, a heating unit, a sensor for determining a quantity of liquid in the outer tub, and a drum, the method comprising:

sensing a quantity of liquid in the outer tub with the sensor;

monitoring a signal from the sensor;

wetting the washing with a quantity of water that is less than a quantity of water required to saturate the washing;

rotating the drum at a first speed, which is greater than a speed required to spread the washing around the drum, until a space between the outer tub and the drum is filled with foam and the foam reaches the interior of the drum; and activating the heating unit and heating the foam and thus the washing.

2. The method of claim 1, further comprising reversing operation of the drum at a second speed which is lower than the speed required to spread the washing around the drum when a predetermined washing temperature is reached, after activating the heating unit.

3. The method of claim 2, further comprising filling with water with a quantity sufficient so that in addition to the saturation quantity a quantity of free liquor is present, which is sufficient for a space between the outer tub and the drum at a lower end of the drum to be filled with water and to allow the washing to be wetted.

4. The method of claim 3, further comprising reversing operation of the drum at a second speed which is lower than the first speed required to spread the washing around the drum.

5. The method of claim 2, further comprising interrupting the reversing operation by rotating the drum at a third speed which is higher than the speed required to spread the washing around the drum.

6. The method of claim 5, wherein the interrupting the reversing operation comprises rotating the drum for a time period from 60 seconds to 3.5 minutes at the third speed which is higher than the speed required to spread the washing around the drum.

7. The method of claim 1, wherein the water quantity is 90 to 170% in relation to the weight of the load.

8. The method of claim 7, wherein the water quantity is 130 to 150% in relation to the weight of the load.

9. The method of claim 1, further comprising interrupting the heating process and operating the drum in a reverse fashion at a second speed which is lower than a speed required to spread the washing around the drum when a predetermined temperature which is lower than a wash temperature is reached.

10. A washing machine comprising:

a drum rotatably supported in an outer tub;

a solution drain system on a base of the outer tub with a solution pump;

a drive motor for the driving the drum;

a heater;

a sensor for determining a quantity of liquid or foam in the outer tub;

a switch for rotating and stopping the drum; and a controller that is adapted to control the drive motor to rotate the drum at a speed which is greater than a speed required to spread a washing around the drum until a space between the outer tub and the drum is filled with foam and the foam reach the interior of the drum in response to the sensor determining that the tub includes a quantity of water that is less than a quantity of water that is required to saturate the washing and that is adapted to control the heater to heat the foam and the washing after the space between the outer tub and the drum is filled with foam and the foam reaches the interior of the drum.

11. The washing machine of claim 10, wherein the controller is adapted to reverse operation of the drum at a second speed which is lower than the speed required to spread the washing around the drum when a predetermined washing temperature is reached, after activating the heater.

12. The washing machine of claim 11, wherein the controller is adapted to fill the washing machine with water with a quantity sufficient so that in addition to the saturation quantity a quantity of free liquor is present, which is sufficient for a space between the outer tub and the drum at a lower end of the drum to be filled with water and to allow the washing to be wetted.

13. The washing machine of claim 12, wherein the controller is adapted to reverse operation of the drum at a second speed which is lower than the first speed required to spread the washing around the drum.

14. The washing machine of claim 11, wherein the controller is adapted to interrupt the reversing operation by rotating the drum at a third speed which is higher than the speed required to spread the washing around the drum.

15. The washing machine of claim 14, wherein the controller is adapted to interrupt the reversing operation by rotating the drum for a time period from 60 seconds to 3.5 minutes at the third speed which is higher than the speed required to spread the washing around the drum.

16. The washing machine of claim 10, wherein the controller is adapted to control the water quantity to be 90 to 170% in relation to the weight of the load.

17. The washing machine of claim 16, wherein the water quantity is 130 to 150% in relation to the weight of the load.

18. The washing machine of claim 10, wherein the controller is adapted to interrupt the heating process and operate the drum in a reverse fashion at a second speed which is lower than a speed required to spread the washing around the drum when a predetermined temperature which is lower than a wash temperature is reached.

* * * * *